US005153994A

United States Patent [19]

Emmett

[11] Patent Number: 5,153,994

[45] Date of Patent: Oct. 13, 1992

[54] HAIR CUTTING SYSTEM

[76] Inventor: Frank E. Emmett, P.O. Box 1056, Penngrove, Calif. 95951

[21] Appl. No.: 749,685

[22] Filed: Aug. 26, 1991

[51] Int. Cl.[5] ..... B26B 19/44; B26B 19/36; H01R 39/08

[52] U.S. Cl. ..... 30/133; 30/41.6; 310/232

[58] Field of Search ..... 30/133, 43.8, 43.9, 30/124, 90, 47, 41.6; 119/96, 106; 310/238

[56] References Cited

U.S. PATENT DOCUMENTS

| | | | |
|---|---|---|---|
| 3,280,456 | 10/1966 | Erickson et al. | 30/133 |
| 3,331,130 | 7/1967 | Ligon | 30/133 |
| 3,603,295 | 9/1971 | Shuman | 119/106 |
| 3,686,514 | 8/1972 | Dube et al. | 310/232 |
| 4,077,122 | 3/1978 | Rollor, Jr. et al. | 30/138 |
| 4,216,581 | 8/1980 | Van Slooten | 30/133 |
| 4,535,264 | 8/1985 | Allport | 310/232 |
| 4,584,964 | 4/1986 | Taplin | 119/106 |
| 4,843,717 | 7/1989 | Crane | 30/133 |
| 4,992,691 | 2/1991 | Mlynarz | 310/232 |

FOREIGN PATENT DOCUMENTS

| | | | |
|---|---|---|---|
| 2524494 | 12/1976 | Fed. Rep. of Germany | 30/133 |

*Primary Examiner*—Douglas D. Watts
*Assistant Examiner*—Paul M. Heyrana
*Attorney, Agent, or Firm*—Larry D. Johnson

[57] ABSTRACT

A hair cutting device comprising a clipper head with powered cutting means. A vacuum pickup tube has a flat entry nozzle extending across the cutting means, tapering back to a circular tubular configuration. The pickup tube is connected to a disposal hose, which is connected to a source of vacuum and the pickup tube is free to rotate on the disposal hose so that the clipper head can be manipulated without twisting the hose. Electric power means include means to maintain electrical contact throughout rotary movements of the clipper head.

7 Claims, 3 Drawing Sheets

HAIR CUTTING SYSTEM

BACKGROUND OF THE INVENTION

The art of cutting hair on a person's head to effect an attractive and stylish hair design, may be developed by one with manual dexterity, only after a considerable amount of training. Hair cuts may be performed by the use and manipulation of scissors in one hand, using a comb and/or the fingers of the other hand to lift the hair free of the scalp to avoid cutting excessive amounts and clusters, and/or leaving irregularities in the contour of the cut. Electric clippers have traditionally been used primarily on male patrons to define the perimeter line of the haircut on the neck and about the ears and to remove the hair below the perimeter line by clipping the hair down to skin level.

Whatever cutting procedure is employed, the clipped hairs naturally drop on the floor as well as onto the shoulders and neck of the client, and smaller particles are suspended in the atmosphere. This necessitates a post-haircut cleanup and poses health and sanitation risks. Others have proposed the use of vacuum means to remove hair particles as they are severed, but such means generally impede manipulation of the cutting tool, and often block the vision of the operator. In addition, the vacuum nozzle and attachments constitute articles of some weight to be handled by the operator, often making the cutting of hair cumbersome and more difficult to control.

OBJECTS OF THE INVENTION

It is an object of this invention to provide a hair cutting instrument that can be held easily with one hand which also simultaneously holds and uses a comb, enabling the haircutter to comb and section the hair and then to switch the comb to the assisting hand which then holds the sectioned portion of hair while the hair cutter uses the clipper to cut.

It is a further object of this invention to provide a hair cutting system that ensures accuracy by causing the hair to stand up just ahead of the cutting blade to facilitate precise cutting and contouring.

It is a further object of this invention to provide a lightweight and highly maneuverable hair cutting instrument that can be used simultaneously with other tools for parting, sectioning and controlling the hair as it is cut.

It is a further object of this invention to provide a hair cutting instrument that can be handled and manipulated easily and efficiently with one hand, leaving the other hand free to section the hair and/or guide the instrument.

It is a further object of this invention to provide means for removing and disposing of severed hair particles without obstructing the view of the operator or burdening him unnecessarily.

It is a further object of this invention to provide a hair cutting device with a vacuum disposal means, which device is easy to manipulate for precision cutting and contouring.

It is a further object of this invention to provide a hair clipper with a vacuum disposal means that pulls the severed hair to a filtering station wherein hair particles are trapped and stored for periodic sanitary removal.

It is a further object of this invention to provide an electric hair cutting tool wherein drive means and cutting means may be replaced as needed, by the operator quickly and conveniently, requiring neither tools nor specific skills.

It is a further object of this invention to provide a hair cutting tool with vacuum disposal means wherein a vacuum hose is easily supported without burdening the operator.

Other objects and advantages of this invention will become apparent from the detailed description to follow, particularly when read in conjunction with accompanying drawings.

SUMMARY OF THE INVENTION

In carrying out this invention, I provide a lightweight, electrically powered clipper, which is easily manipulated by the operator. A vacuum hose, with a flat, wide intake nozzle is secured to the back of the razor and disposed so that the plane of the nozzle opening is substantially parallel to that of the cutting blades, causing the strands of hair to stand erect and under tension as they are being cut. Electrical conductors are carried by the vacuum hose, and a swivel joint in the hose just behind the clipper allows the operator to twist, turn and otherwise manipulate the clipper to enable him or her to shape the hair without also twisting and turning the trailing vacuum hose and electric cord. The cutting blades, which are cam driven by a small electric motor in the cutter head, are quickly and easily replaced, as is the motor itself, as may be necessary.

DETAILED DESCRIPTION OF A PREFERRED EMBODIMENT

Figure 1:
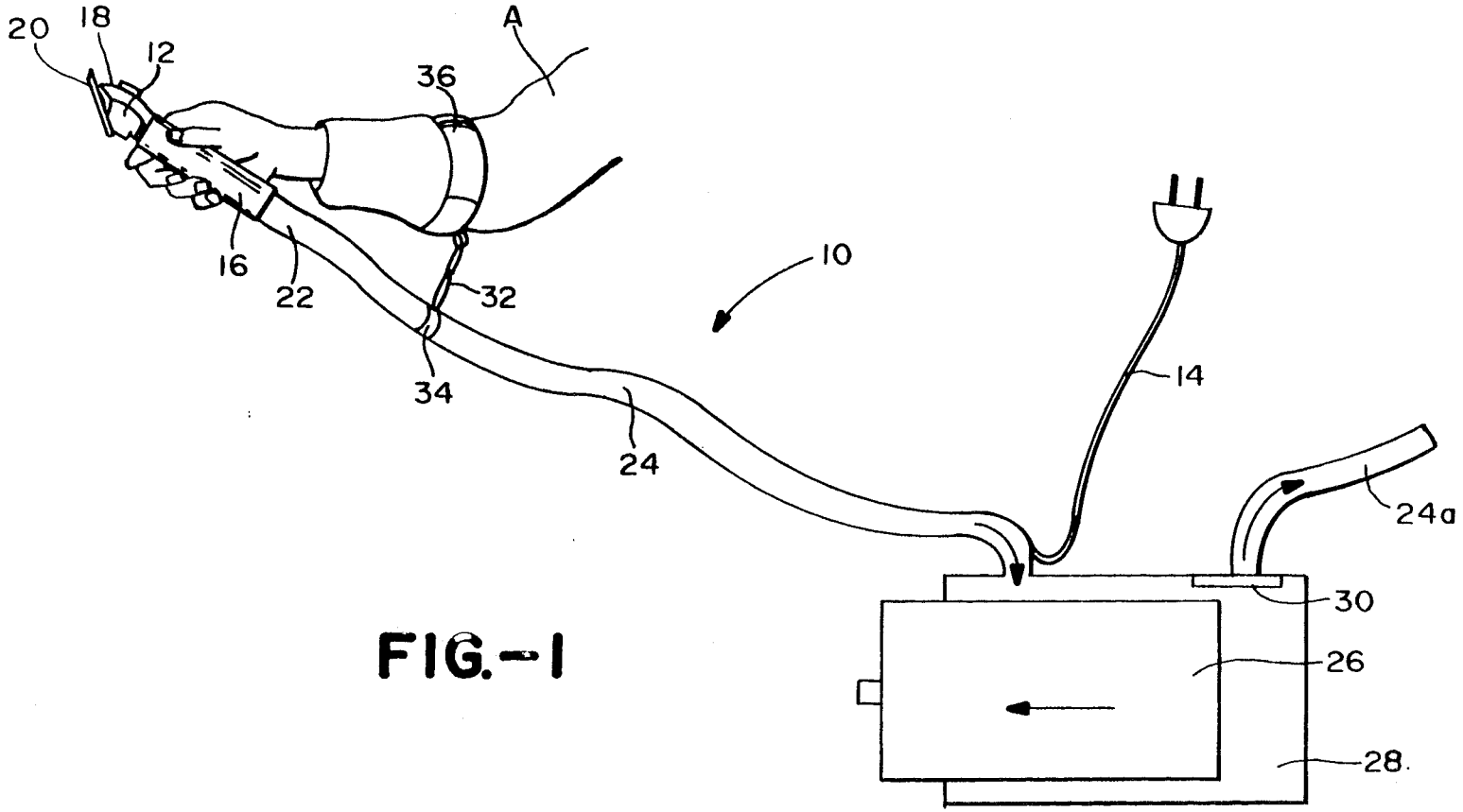
FIG. 1 is a view in perspective of the hair cutting system of this invention.

Referring now to FIG. 1 with greater particularity, the hair cutting system 10 of this invention includes a small, easily handled clipper 12 which is powered from a source of electricity through a conductor 14. The clipper handle 16 is of generally cylindrical, tubular configuration containing a pickup vacuum hose 17 (FIG. 2) that is flattened at 18 into a relatively wide vacuum intake nozzle 19, which is disposed parallel to, and directly over, the cutting blades 20 of the clipper 12.

The pickup vacuum hose 17 is connected in a swivel joint 22 (FIG. 1) to a hair clippings disposal tube 24, which opens into a collector drawer 26 of a clipping receptacle 28. Hair is separated from the vacuum stream by a suitable filter 30 before the air is drawn to a suitable vacuum source (not shown) through a source vacuum hose 24*a*.

The vacuum disposal hose 24 is preferably supported from the forearm A of the operator or cosmetologist by a cord 32, which is secured between a band 34 around the hose 24 and an arm band 36, which is secured, as by means of a VELCRO ® fastener. Hence, by supporting the weight of the hose 24 on the forearm, the hand and wrist are free of weight and pressure to manipulate the handle 16 to twist and turn the clipper 12 and vacuum intake nozzle together as a unit in order to effect the desired contour of the hair cut.

Figure 2:
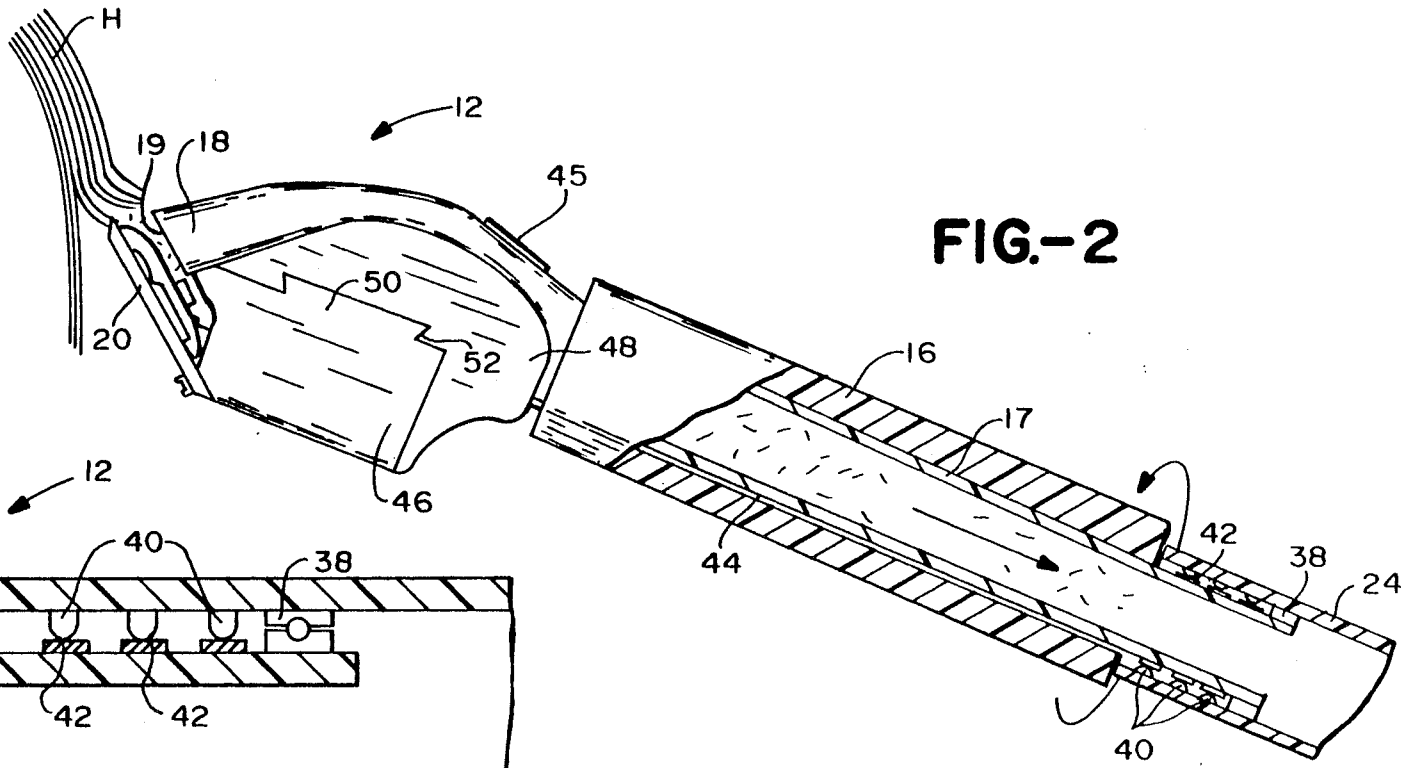
FIG. 2 is a side view, partially in section of the hair cutting tool.
Figure 3:
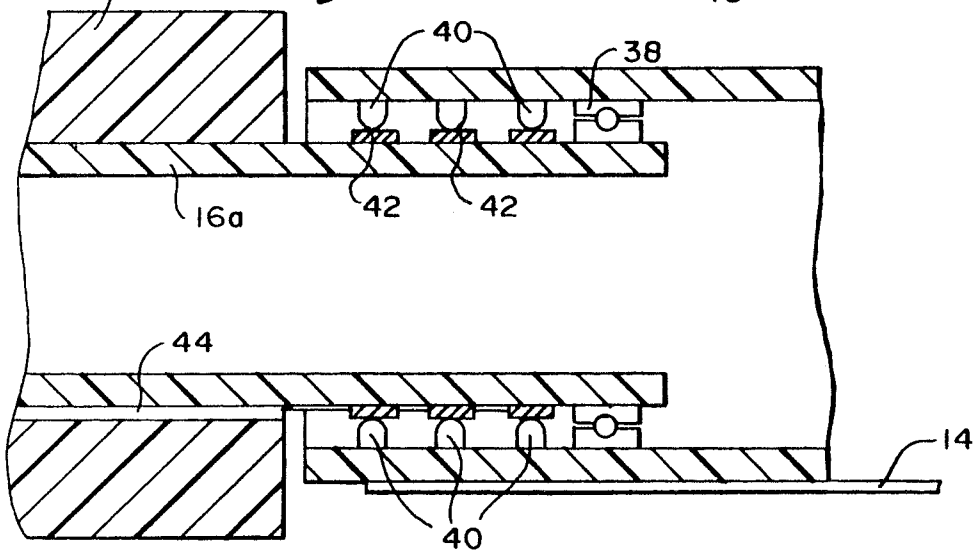
FIG. 3 is an enlarged section view of the electrical and vacuum connection.

Referring now more particularly to FIGS. 2 and 3, the hair cutting device or clipper 12 is preferably provided with a tubular handle 16 in which is contained the end of the vacuum pickup hose 17. The hair clipping disposal hose 24 is connected to the pickup tube 17 in a swivel joint 38 that allows the hair cutting device 12 to be angled and turned as needed to sculpt the hair H (FIG. 2).

The electric power cord 14 may be carried on the disposal hose 24, and it terminates in one or more power contacts 40 which ride on contact rings 42, which in turn, are carried on the vacuum pickup hose 17. The contact rings 42 are connected to a suitable conductor 44 to power the clipper 12. An on-off switch 45, of a suitable height, such as a membrane switch, is provided on the back of the clipper for convenient operation by the operator with a simple movement of the thumb. The clipper and vacuum operate only when pressure is maintained on the switch: when thumb pressure is released, the clipper and the vacuum automatically cease operating. As noted particularly in FIG. 2, air flow into the relatively wide, but flat nozzle 18 is directed approximately perpendicularly to the cutting blades 20 so that the portion of the section of hair H which rises loosely from the fingers of the operator may be pulled toward the vacuum nozzle and reduced in length by the clipper to any desired point right up to the fingers of the operator, who during this operation continues to hold the remainder of the previously-combed section of hair away from the scalp under tension.

Figure 4:
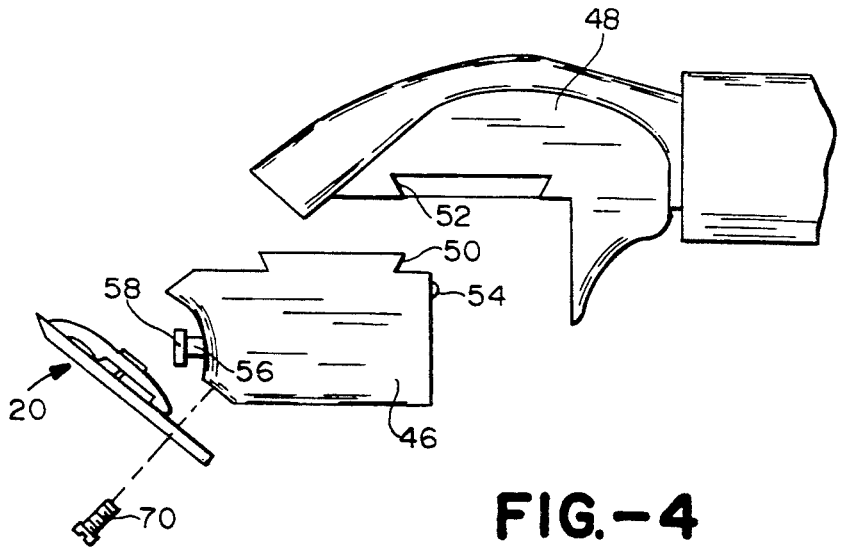
FIG. 4 is an exploded view of the cutting head and drive means for the cutting tool.
Figure 5:
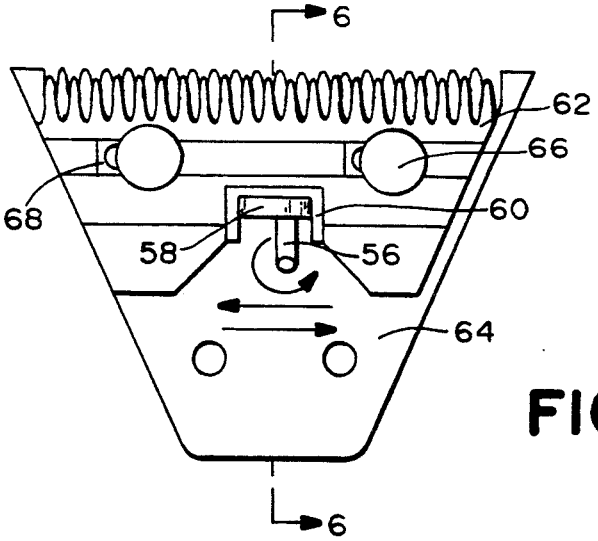
FIG. 5 is a top view of the cutting blade assembly.
Figure 6:
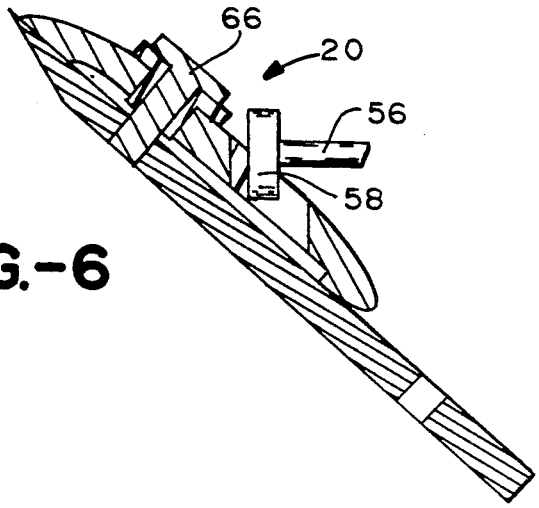
FIG. 6 is a section view taken along line 6—6 of FIG. 5.

As shown particularly in FIGS. 2 and 4, the motor module 46 is retained on the power head 48, being received in a dovetail tongue and groove connection 50, 52 and secured in place, as by retainer detentes 54 which serve also as power contacts. The motor module 46 has a rotary output shaft 56 on which is carried a cam or eccentric 58 that engages cam follower surfaces 60 (FIG. 5) of plastic or the like to minimize noise.

A toothed clipper blade 62 is mounted on a stationary blade 64 for reciprocation thereon, and suitable hand-tightened anchor pins 66 are received through slots 68 in the moveable blade 62 to enable reciprocation thereof. Plastic noise reducing buttons are preferably placed in the slots 68. The entire blade assembly 20 is secured to the motor module 46, as by means of a small screw 70.

Hence, it is apparent that the motor module 46 and the blade assembly or cutting head 20 may be easily removed without tools from the unit 12 for replacement of the complete cutter head. The blades themselves are easily removed by removal of the screw 70 for replacement of the blade assembly.

While this invention has been described in connection with preferred embodiments thereof, it is obvious that modifications and changes therein may be made by those skilled in the art to which it pertains without departing from the spirit and scope of the invention, as defined by the claims appended thereto.

What is claimed as invention is:

1. A hair cutting device comprising:

a clipper head having a leading end with cutting blades thereon and a trailing end, said cutting blades defining a plane;

a pickup vacuum tube attached to said clipper head and having a relatively flat nozzle entry end, said nozzle entry end defining a plane generally parallel to said cutting blade plane and disposed at and along said leading end, said pickup vacuum tube further having a transfer end extending rearward from said trailing end;

a disposal hose connected at one end to the transfer end of said pickup tube and at the other end to a source of vacuum.

said clipper head and pickup tube being freely rotatable on said disposal hose;

a motor to drive said cutting blades;

an input power line to be connected to a source of power;

a separate delivery power line connected to said motor and carried on and extending along said pickup vacuum tube; and means for coupling said power lines for maintaining power contact between said input power line and said delivery power line throughout rotary movements of said pickup vacuum tube.

2. The hair cutting device defined by claim 1 wherein:

said motor is electrically energized; and said power lines are electrical conductors.

3. The hair cutting device defined by claim 2 including:

a rotary output shaft on said motor; and a rotary cam on said output shaft;

a first cutter blade;

a second cutter blade mounted for reciprocal movement on said first cutter blade; and follower means on said second cutter blade engaged by said cam to be reciprocated thereby.

4. The hair cutting device defined by claim 3 including:

first releasable means removably securing said cutter blades onto said motor.

5. The hair cutting device defined by claim 3 including:

second releasable means removably mounting said motor and cutter blades on said clipper head.

6. The hair cutting device defined by claim 1 including:

means for attaching said disposal hose to the forearm of an operator to support said disposal hose without impeding hand manipulation of said clipper head and pickup vacuum tube.

7. The hair cutting device defined by claim 1 including:

a clipping collector receptacle connected in said disposal hose.

* * * * *